US006059924A

United States Patent [19]

Hoskins

[11] Patent Number: 6,059,924

[45] Date of Patent: May 9, 2000

[54] FLUFFED PULP AND METHOD OF PRODUCTION

[75] Inventor: Martin G. Hoskins, Brunswick, Ga.

[73] Assignee: Georgia-Pacific Corporation, Atlanta, Ga.

[21] Appl. No.: 09/002,348

[22] Filed: Jan. 2, 1998

[51] Int. Cl.[7] ..... D21C 9/00

[52] U.S. Cl. ..... 162/9; 162/28; 162/100; 241/21

[58] Field of Search ..... 162/100, 28, 9; 241/21

[56] References Cited

U.S. PATENT DOCUMENTS

| | | | |
|---|---|---|---|
| Re. 26,151 | 1/1967 | Duncan et al. . | |
| 1,651,665 | 12/1927 | Bradley | 162/100 |
| 2,516,384 | 7/1950 | Hill et al. | 162/100 |
| 3,382,140 | 5/1968 | Henderson et al. | 162/28 |
| 3,519,219 | 7/1970 | Zelnick . | |
| 3,672,630 | 6/1972 | Naumburg et al. . | |
| 3,750,962 | 8/1973 | Morgan, Jr. . | |
| 3,772,732 | 11/1973 | Gilmore . | |
| 3,809,604 | 5/1974 | Estes | 162/100 |
| 4,036,679 | 7/1977 | Back et al. | 162/9 |
| 4,065,347 | 12/1977 | Aberg et al. . | |
| 4,081,316 | 3/1978 | Aberg et al. . | |
| 4,247,362 | 1/1981 | Williams . | |
| 4,455,237 | 6/1984 | Kinsley . | |
| 4,700,900 | 10/1987 | Rowland . | |
| 4,917,762 | 4/1990 | Dalkier . | |
| 5,262,005 | 11/1993 | Eriksson et al. | 162/100 |
| 5,536,369 | 7/1996 | Norlander . | |
| 5,547,541 | 8/1996 | Hansen et al. . | |
| 5,607,546 | 3/1997 | Höglund et al. . | |
| 5,776,305 | 7/1998 | Sabourin | 162/23 |

FOREIGN PATENT DOCUMENTS

| | | |
|---|---|---|
| WO 90/05808 | 5/1990 | WIPO . |
| WO 97/39188 | 10/1997 | WIPO . |
| WO 98/17856 | 4/1998 | WIPO . |

OTHER PUBLICATIONS

James D'A Clark, "Chapter 13," Pulp Technology and Treatment for Paper, 2nd Ed., 306–355, 19.

*Primary Examiner*—Peter Chin
*Attorney, Agent, or Firm*—Banner & Witcoff, Ltd.

[57] ABSTRACT

An improved method of preparing a fluff pulp sheet used to produce fluffed pulp exhibiting enhanced dry compression and liquid wicking and retention characteristics using typical paper-making equipment, wherein a chemical pulp slurry is mildly refined prior to the steps of sheet formation, pressing and drying.

9 Claims, 1 Drawing Sheet

FLUFFED PULP AND METHOD OF PRODUCTION

BACKGROUND OF THE INVENTION

1. Field of the Invention

This invention broadly relates to an improved method of preparing a fluffed pulp exhibiting enhanced dry compression and liquid wicking and retention characteristics. The invention further relates to a fluff pulp sheet product, to the fluffed pulp made using the sheet product and to absorbent articles made using the fluffed pulp.

2. Description of Related Art

Absorbent articles such as disposable diapers, sanitary napkins, and the like, represent one of the major applications for chemically-treated pulp (chemical pulp).

Chemical pulp is prepared by chemically treating cellulosic materials, such as softwoods and hardwoods, to remove their lignin fraction and produce a cellulosic pulp suitable for making paper and related non-woven products. Foremost among the chemical processes are the well-known Kraft and sulfite pulping processes. In the Kraft pulping process, a cellulosic source such as wood chips is digested with an alkaline pulping liquor containing sodium hydroxide and sodium sulfide; while the sulfite process, as the name implies, employs a sulfurous acid solution of an alkali or alkaline earth metal sulfite to effect lignin removal. All known processes also generally rely on some type of post-digestion bleaching to obtain additional lignin removal, and increase the whiteness and brightness of the pulp to enhance commercial acceptance. To produce a pulp product having a sufficient whiteness and brightness for making non-woven mats, the lignin content of the pulp generally is reduced to below about 10 weight percent.

Chemical pulp processed by dry defibration for incorporation into absorbent products is called fluffed pulp. Fluffed pulp is often marketed in the form of roll pulp, but also can be sold in sheet form as bales (hereinafter both referred to a dried fluff pulp sheets). Conventional fluff pulp sheet is manufactured, following the chemical pulping operation, by forming the pulp into a sheet or non-woven mat by any one of several well-known wet-forming processes typified by the conventional Fourdrinier process. In a first step, bleached chemical pulp is deposited upon a screen (or "wire") to form a mat or web of pulp fiber. This step, known in its initial stage as formation, is usually accomplished by passing an aqueous dispersion of a low concentration of pulp (e.g., 0.5% to 1% by weight solids is typical) over the screen. This screen, assisted in certain situations by vacuum or suction, increases the consistency of the mat or web to approximately 20 to 35 weight percent solids.

In a second step, the mat or web is compressed or squeezed in a "press section" to remove additional water. This is usually accomplished by felt presses, a series of rollers each having a felted band for contact with the mat or web. These presses remove additional free water and some capillary water, thus resulting in an increase in consistency of the mat or web to a range of about 30 to 60 weight percent. As is well known, in making fluff pulp sheet, less pressure is applied in this portion of the process than normally would be encountered in conventional paper-making, thus less water is removed in this section. Less pressing is done so as to facilitate subsequent comminution of the fluff pulp sheet to the defibrated fluffed pulp.

Following the press section, the pulp sheet is then dried in a dryer section. Because a reduced amount of water was removed in the press section, more moisture must be removed from the sheet in the dryer section than generally is necessary in paper-making. In the drier section, the remaining water content of the pulp sheet is reduced to obtain a pulp consistency which typically ranges between about 88 to 97 weight percent (3 to 12 weight percent moisture), more usually between 90 to 94 weight percent (6 to 10 weight percent moisture).

For use in absorbent products such as diapers, the sheets formed in this manner are thereafter comminuted using a variety of known techniques and machines such as hammer-mills. The comminuted pulp is referred to hereinafter as fluffed pulp. The fluffed pulp fibers can then be used to form an absorbent product.

While absorbent articles made using conventionally produced fluffed pulp have been accepted commercially, common disadvantages associated with the use of standard chemical fluffed pulp include its limited dry compression characteristics and its limited liquid wicking and water retention property. One consequence of limited dry compression is that the energy requirement for making densified absorbent products is higher than if the pulp exhibited a greater degree of dry compression. Poor wicking property reduces the pulp's re-wetting ability, i.e. its ability to retain moisture when subjected to several doses (insults) of liquid, and impedes the distribution of fluid through a mat of the fibers.

U.S. Pat. No. 4,065,347 describes making fluffed pulp from bales or blocks of an unwashed mechanical pulp, made by defibration of wood chips in a defibrator or refiner.

U.S. Pat. No. 4,081,316 relates to a purportedly improved fluffed pulp produced by a method comprising the steps of mixing ground wood (mechanical pulp) with a portion of a beaten chemical pulp, mechanically dewatering the wet mixture, coarse-defibrating the dewater fibers, drying in a flash drying step, finish defibrating and finish drying.

U.S. Pat. No. 5,547,541 describes a process that purportedly produces a fluff pulp sheet which allows for an improved densification of fluffed fibers. The process requires the addition of a chemical densifying agent to the pulp fibers following sheet formation. The addition of such chemicals to the pulp adds significantly to the cost of the pulp fibers and may affect liquid transport and liquid retention characteristics of the final pulp fibers in unanticipated ways.

As a result, a method of treating pulp fibers to improve their densification (compaction) properties, which method does not involve a chemical treatment, would represent a significant improvement in the art of making a fluffed pulp.

Accordingly, it is an object of the present invention to provide a method that produces a fluffed pulp of improved compaction characteristics.

It is another object of the present invention to provide a method of processing chemical pulp that produces a fluffed pulp of improved wicking, liquid retention and liquid distribution characteristics.

The present invention relates to these and other objects which will become readily apparent from a reading of the following description of the invention and accompanying drawings.

BRIEF DESCRIPTION OF THE INVENTION

The present invention is directed to an improvement in the conventional process for making a fluff pulp sheet, and ultimately a fluffed pulp, which improvement comprises subjecting a chemical pulp slurry, prior to sheet formation, to a mild step of mechanical refining. According to one aspect of the invention, the mild mechanical refining is sufficient, in combination with standard well-known wet-forming processes for making fluff pulp, to produce a fluff pulp sheet having a burst index value between about 0.5 and about 3.0 $kPa \cdot m^2/g$ and a density between about 0.4 and about 0.7 $g/cm^3$.

This invention is directed not only to a method of producing dried fluff pulp sheets comprised totally or substantially of chemically pulped wood fibers as the fiber source and to the production of absorbent products from the fluffed pulp produced from such sheets, but also to the dried sheets of fluff pulp fibers per se.

DETAILED DESCRIPTION OF THE INVENTION

The present invention is based on the discovery that by mild mechanical refining of a chemical pulp used to form a fluff pulp sheet, in what otherwise can be a standard wet-forming process for making fluff pulp, the dry compression characteristics and the wicking property of the fluffed pulp thereafter made from the fluff pulp sheet are significantly enhanced.

Figure 1:
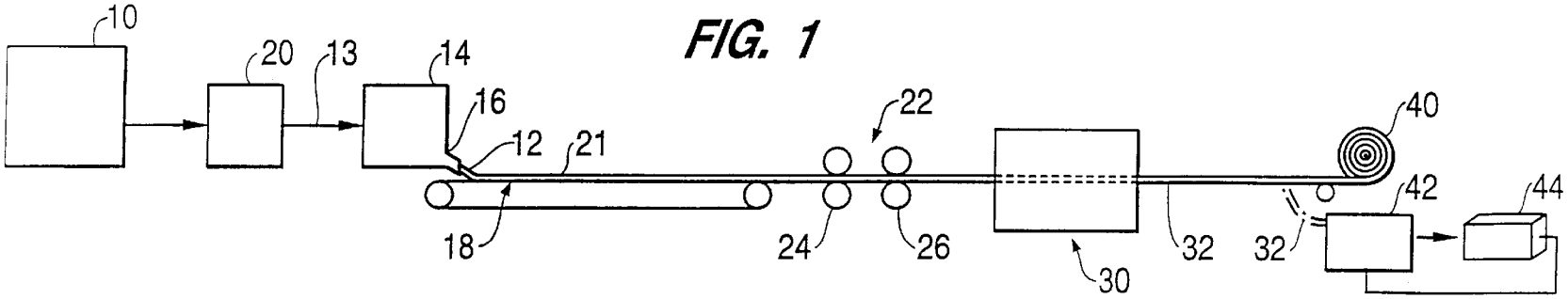
FIG. 1 is a schematic drawing of a process according to the present invention.

With reference to FIG. 1, an embodiment of the present invention is illustrated, which will be used to describe the features and advantages of the present invention. In accordance with the present invention, a chemical pulp slurry, generally bleached and optionally augmented with other fibers as hereinafter described, is obtained from a chemical pulp stock chest 10, generally at a consistency of 2 to 4% by weight. As described hereinafter, higher pulp consistencies can be used depending upon the nature of the mechanical refining equipment employed in carrying out the process.

Wood fibers most preferred for use in making the chemical pulp used to produce the dried fluff pulp sheet of the present invention (and ultimately the fluffed pulp used in absorbent products such as diapers) are generally derived from long fiber coniferous wood species, such as pine, douglas fir, spruce and hemlock, i.e., softwoods (gymosperms). Suitable species include *Picea glauca* (white spruce), *Picea mariana* (black spruce), *Picea rubra* (red spruce), *Pinus strobus* (white pine), *Pinus caribeau* (slash pine), and *Pinus tadea* (loblolly pine). In the broad practice of the invention, such softwood chemical pulp can be augmented with hardwood (angiosperm) chemical pulp fibers, for example, from alder, aspen, oak, and gum and with wood pulp fibers obtained from mechanical pulping processes, such as ground wood, thermomechanical, chemimechanical, and chemithermomechanical pulp processes. Additional fibers also can be added from any of a variety of other natural or synthetic fiber sources such as chopped silk fibers, bagasse, hemp, jute, rice, wheat, bamboo, corn, sisal, cotton, flax, kenaf, peat moss, acrylic, polyester, carboxylated polyolefins, rayon and nylon. Generally, these mechanical pulp fibers and non-wood fibers will constitute less than about 40% by weight of the dry pulp fiber weight, and most often less than about 10% by weight.

In accordance with FIG. 1, the chemical pulp slurry is delivered from stock chest 10 to refiner 20 wherein the pulp fibers are subjected to a mild step of mechanical refining. The refiner can be any of the well known units used in the manufacture of mechanical or thermomechanical pulps or in the refining of chemical pulp, which are well understood by those skilled in the art. The following equipment can be mentioned as being suitable for use in the mild refining step of the present invention, Defibrator L-42, Asplund defibrators types OVP-20, RLP-50S, and RLP-54S, disk refiners such as those manufactured by Sprout-Bauer, Inc., and the like. These units typically comprise one stationary disc and one rotating disc. Optionally, the refiner units can have two rotating disks. Disc designs can be any of those commonly used in the pulp refining. The mild mechanical refining operation also can employ Hollander beaters or conical refiners such as Jordans or Clafins. High consistency pulp processors can also be used such as the Frotapulper or the Micar mixer manufactured by Black Clawson.

In the broad practice of the invention, pulp consistencies suitable for practicing the mild mechanical refining step can range from about 1 to about 40% by weight. The invention, however, is not to be limited to any particular type of refining equipment or specific pulp consistency during the refiner operation.

Relative to standard or conventional refiner operation encountered in connection with the production of paper products, the refining step of the present invention is operated at a much reduced level of power input, hereinafter referred to as mild refining. A suitable level of input power in accordance with the present invention will be a function of the pulp consistency, the throughput of the equipment, the particular refiner equipment and design employed, such as in the case of a disc refiner, the refiner plate gap, the plate design and plate rotational speed. Generally, at higher pulp consistencies and faster pulp throughputs, a higher level of power will be required for the refining step. For example, when operating at a pulp consistency of about 3% with a disk refiner, it has been observed that the power input to the refiner can be in the range of 0.5 to 1.0 hp-day/ton of dry pulp to produce a dried fluff pulp sheet, which when removed from the drier section and having the particularly desired fiber properties, such as a burst index value of about 1.5 to about 2.5 $kPa \cdot m^2/g$ and a density between about 0.5 and about 0.6 $g/cm^3$, will thereafter produce a fluffed pulp having enhanced dry compression and liquid wicking and retention characteristics. The input power suitable for effecting a mild refining of the chemical pulp for any particular combination of pulp consistency, throughput and refiner design can be readily ascertained by one skilled in the art using only routine experimentation and guided by the teachings of the present invention.

It is well understood by those skilled in the art that mechanical refining of a wood pulp normally produces several significant changes to the properties and characteristics of the individual pulp fibers. For example, the external fiber surfaces are damaged and peeled away creating debris and fines. The walls of the individual fibers also are separated into layers or lamellae. Such changes can influence the ability of a fiber to take up liquid and can reduce the stiffness of the so-modified fiber. Generally, the average fiber length of the pulp, most commonly measured with an optical measuring device such as a Kajaani Fiber Analyzer (or an equivalent piece of equipment) also is reduced as a result of mechanical refining. Indeed, for many paper-making processes the reduction of average fiber length is the primary reason for refining the pulp. In any event, a significant reduction of average fiber length is a common feature of conventional refining.

In contrast to such paper-making processes, it is a key purpose and feature of the present invention to limit the amount of refining energy imparted to the fibers by effecting only a "mild" refining of the pulp and thus to limit the nature of the changes (damage) imparted to the pulp fibers. In particular, it is an important feature of the mild mechanical refining of the present invention that the average length of the fibers be preserved as much as possible through the refining step. In this way, the invention is able to render the fibers more compressible in the dry state while minimizing any adverse impact on absorbent properties that a standard mechanical refining operation would cause. Loss of average fiber length in a pulp produced for making a fluffed pulp results in the fluffed pulp exhibiting poorer absorbent properties and results in products formed using such fluffed pulp (dry formed pads) exhibiting poorer strength.

In this regard, it has been observed that when operating at a pulp consistency of about 3%, and limiting the power input to the disc refiner (the refiner energy of a disk refiner) in the range of about 0.5 to 1.0 horsepower day per ton of pulp solids, little to no reduction in average fiber length occurs. Surprisingly, fluffed pulp ultimately made from dried fluff pulp sheets made from the mildly refined pulp exhibits an improved dry compressibility property and improved liquid retention and liquid distribution characteristics. In order to maximize the benefits observed from the mechanical refining operation, it is important to perform only a mild refining of the pulp such that in preferred operation the fiber length of the pulp is reduced by no more than about 20%, preferably no more than about 15%, and more preferably no more than about 10%. Generally, reductions in the average fiber length of from about 0 to 5% can be expected.

As a less exact way of monitoring the degree of refining, one can also refer to the Canadian standard freeness value (CSF) of the predominately softwood fibers (e.g., Southern pine) determined (according to T.A.P.P.I. Method T-227 OS-58) before and after the refining step. As noted above, refining damages the outer surface of the individual pulp fibers and peels away pieces of the outer layers creating debris and/or fines. As the refining energy (input power) is increased, so too is the amount of debris and fines created, which results in a greater decrease in freeness. Generally, the CSF of a standard chemical pulp prior to any refining step is in the range of 700 to 750. For the purpose of this invention, it normally is desirable to limit the amount of refining (i.e. to perform only a mild mechanical refining) so that there is no more than about a 5 to about a 10% drop in pulp freeness.

Refining can be conducted in a single stage or in several stages. Also, either a pressurized or non-pressurized refiner can broadly be used. Generally, a single stage of non-pressurized refining should be suitable. Further details concerning the refining of pulp, suitable refining equipment and operation thereof can be obtained by reference to *Pulp Technology and Treatment for Paper,* 2nd Ed., James d'A Clark (Chapter 13), Miller Freeman Publications, Inc., pp. 306–355, the disclosure of which is incorporated herein by reference.

Following the refining step, the aqueous slurry of mildly refined, predominately chemical pulp fibers is reduced to a consistency of about 0.5 to 1.0% by the addition of water as needed through line 13 and processed into a dried fluff pulp sheet using anyone of the variety of wetforming techniques well known in the art for forming sheets or mats of non-woven fibers. Of particular usefulness are the various modifications of the well known Fourdrinier process. In general, this process involves adjusting the pulp furnish to the noted consistency, applying the furnish to a moving foraminous surface such as a Fourdrinier wire, allowing excess water to drain from the fiber mat so-formed through the foraminous surface, and subjecting the drained fiber mat to various pressing operations so as to expel more water. Other mat forming equipment such as the cylinder and twin-wire machines can alternatively be employed, and the present invention is not limited to any particular mat formation procedure or apparatus.

As is well known to those skilled in the art of making conventional fluff pulp sheets, a pressing operation is conducted to optimize moisture reduction without excessive wet mat compaction or densification. The lightly pressed coherent fibrous web is then dried by any convenient means such as a drying tunnel or rotating drum dryer. In the broad practice of the present invention, the dried sheet of fluff pulp fibers typically has a caliper of 20 to 80 mils, a basis weight of 200 to 900 g/m$^2$, a burst index of 0.5 to 3.0 kPa·m$^2$/g. The dried pulp sheet generally has a density of 0.4 to 0.7 g/cm$^3$. Upon subsequent defibration, the fluffed pulp exhibits improved compaction characteristics and improved liquid wicking and liquid retention characteristics relative to a fluffed pulp made from a fluff pulp sheet produced under substantially the same web formation and drying characteristics but without the mild refining operation. Thus the impact of various levels of mild refining can be easily assessed by those skilled in the art using routine experimentation. The dried fluff pulp sheet then can be cut into convenient sections and baled or more usually is wound upon a core to form a convenient sized roll.

With specific reference to FIG. 1, a pulp slurry 12 is delivered from a headbox 14 through a slice 16 and onto a Fourdrinier wire 18. As noted above, the pulp slurry 12 typically includes cellulose fibers such as chemically digested wood pulp fibers as its main component and may also include as a minor component, mechanical wood pulp and synthetic or other non-cellulose fibers as part of the slurry. Water is withdrawn from the pulp slurry deposited on wire 18 by a conventional vacuum system, not shown, leaving a deposited pulp sheet 21 which is carried through an initial mechanical dewatering section 22, illustrated in this case as two sets of calendar rolls 24, 26 each defining a respective nip through which the pulp sheet or mat 21 passes.

From the dewatering section, the pulp sheet 21 enters a drying section 30 of the pulp manufacturing line. In a conventional fluff pulp sheet manufacturing line, drying section 30 may include multiple cylinder or drum dryers with the pulp mat 21 following a serpentine path around the respective dryers and emerging as a dried sheet or mat 32 from the outlet of the drying section 30. The pulp dryer section of the fluff pulp sheet manufacturing process usually includes a series of steam-heated cylinders. Alternate sides of the wet pulp web are exposed to the hot surfaces as the sheet passes from cylinder to cylinder. In most cases, the sheet is held closely against the surface of the dryers by a fabric having carefully controlled permeability to steam and air. Heat is transferred from the hot cylinder to the wet sheet, and water evaporates. Other alternate drying mechanisms, alone or in addition to cylinder or drum dryers, may be included in the drying stage 30. Typically, the dried pulp sheet 32 emerging from the drier section has an average maximum moisture content of no more than about 12% by weight of the fibers, more preferably no more than about 6% to 10% by weight and most often about 8%.

In the FIG. 1 embodiment, the dried sheet 32 is taken up on a roll 40 for transportation to a remote location, that is, one separate from the pulp sheet manufacturing line, such as at a user's plant for use in manufacturing fluffed pulp absorbent products. Alternatively, the dried sheet 32 can be collected in a baling apparatus 42 from which bales of the fluff pulp 44 are obtained for transport to a remote location.

In the broad aspects of the present invention, it is also contemplated that the pulp may be treated with bond-inhibiting chemical substances, debonders as they are commonly called, chemical softeners, or other chemical additives during preparation of the fluff pulp sheet to alter processing or aesthetic characteristics of the finished fluff pulp or finished fluffed pulp and the absorbent products made from said fluffed pulp. The addition of such chemicals is normally effected by adding the chemical to the pulp prior to sheet formation or by spraying the pulp after the formation of the non-woven sheet or mat and sometimes during initial mechanical dewatering. Included within such materials are fatty acid soaps, alkyl or aryl sulfonates, quaternary ammonium compounds and the like. Usually, such materials would be used in an amount of below about 0.5% by weight and often below about 0.1% by weight of dry pulp.

Absorbent products of this invention can be prepared from the hereinbefore described dried fluff pulp sheets by a process comprising the steps of comminution, mat formation and, generally, mat compaction. Comminution (i.e. the mechanical separation of the dried fluff pulp sheets into essentially individual fibers) is accomplished using any of the equipment and processes well known to those skilled in the art. Often, defiberization is conducted in a hammermill; in a Bauer mill; in a Fritz mill; between a pair of counter-rotating, toothed rolls; in a disc refiner; in a carding device, or the like. Examples of suitable equipment can be found in U.S. Pat. No. 3,750,962 and in U.S. Pat. No. 3,519,219, both of which are incorporated herein by reference. As noted, a disk refiner is a potential apparatus for the defiberizer operation, which also can be employed to effect additional separation of fibers (removal of knots) if required following a different piece of defibrating equipment. The disk refiner can be of a type known in the art and a representative disk refiner is type DM36 manufactured by Sprout-Bauer, Incorporated of Muncie, Pa.

Following comminution of the fluff pulp sheet, the separated, fluffed pulp fibers are formed into a fibrous web using equipment and processes common in the art. In this regard, U.S. Pat. No. 3,772,739, incorporated herein by reference, illustrates a suitable process. The present invention is not limited to any specific manner of making an absorbent article. Usually the non-woven web is thereafter compressed by means well known in the art to form the absorbent product.

In accordance with the present invention, absorbent structures or articles may be made from the fluffed pulp fibers. These articles may be composite structures (e.g., made of several materials). For example, the articles may have a core of several types of fibers, or fiber layers, with or without covering materials. These products are capable of absorbing significant quantities of water and other fluids, such as urine and other body fluids. Such products include, but are not limited to, disposable diapers, sanitary napkins, incontinent pads, absorbent towels and the like.

Figure 2:
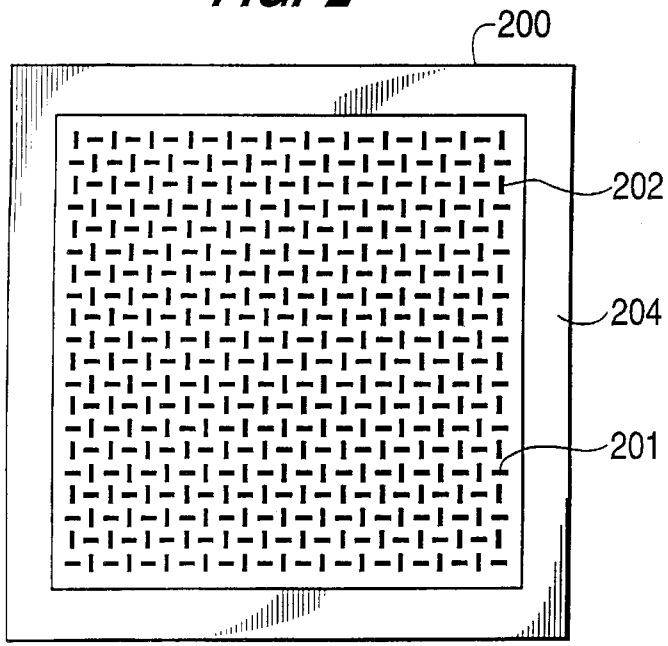
FIG. 2 is a top plan view of an absorbent article into which fibers of the present invention can be incorporated, the fibers being in the form of an illustrated absorbent pad.
Figure 3:
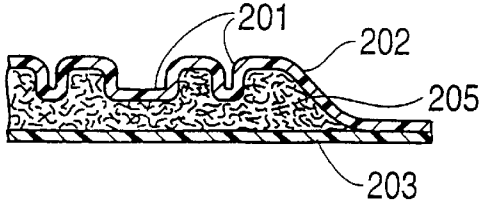
FIG. 3 represents a partial sectional view of the pad of FIG. 2.

FIGS. 2 and 3 illustrate an absorbent pad structure which may be formed from fluffed pulp fibers of the present invention, whether or not they are blended with other fibers. The absorbent pad structure may also include thermoplastic fibers. The pad structure may optionally contain superabsorbent polymers in the form of granules or fibers. Superabsorbents are available commercially and include starch graft copolymers, crosslinked carboxymethylcellulose derivatives and modified hydrophilic polyacrylates. These materials possess the ability to absorb large volumes of liquid, often in excess of 20 to 30 times their own weight. An example of a commercially available superabsorbent is Favor SXM 77, manufactured by Stokhausen, Inc., Greensboro, N.C.

FIGS. 2 and 3 represent an absorbent pad 200 having a heat embossed screen pattern 201. Pads having no pattern may also be used. A pad having a cover sheet 202 a backing sheet 203 may be formed, for example, by placing a square fiber piece cut from the sheet onto a corresponding precut backing sheet. A corresponding precut cover sheet is placed over the top of the fiber mat 205 on the backing sheet. This assembly may then be adhesively bonded around a continuous margin 204.

When intended for use in products such as disposable diapers, the compressed fluffed pulp mat may have a basis weight of from about 100 to 1000 g/m$^2$, and a dry density of from about 0.05 to about 0.25 grams per cubic centimeter. Those skilled in the art can readily adjust these parameters to suit the particular end product use. Diapers can be made from the fluffed pulp according to the teachings of U.S. Pat. No. Re. 26,151 which is incorporated herein by reference. Other absorbent products, such as sanitary napkins, incontinent pads, surgical bandages, and the like, also can be prepared from the fluffed pulp of this invention by means well known to those skilled in the art.

Fluffed pulp produced in accordance with the present invention is significantly less expensive than the pulp fibers treated with a chemical densifying agent in accordance with U.S. Pat. No. 5,547,541, yet the fluffed pulp of the invention has comparable performance characteristics.

The following examples are provided for exemplification purposes only and are not intended to limit the scope of the invention which has been described in broad terms above.

Testing Methods

Caliper of sheet fluff pulp—Using a TMI Micrometer Model 49–72 the thickness of a single sheet is measured under a set fixed static load.

Caliper of fluffed pulp pad—Using a Frazier Compressometer (Fraizer Precision Instruments Co., Inc., Hagerstown, Md.), the thickness of a single pad (50 mm×50 mm) is measured under a set fixed static load of 7 psi.

Dry Density of sheet fluff pulp—Representative sheet samples (twelve inch square sample size) of fluff pulp are dried for one hour at 105° C. in a convection oven and then weighed. The caliper is determined using a TM Micrometer Model 49–72. The weight, sheet area and caliper are used to calculate and report the average sheet density in g/cm$^3$.

Burst Index of sheet fluff pulp—the Burst strength (Mullen) divided by the basis weight. Burst Index is expressed in units of kPa·m$^2$/g. The Burst strength is measured using Mullen Tester Model CA. Five samples having a size of about three by twelve inches are taken from various sections of a pulp sheet and a hydrostatic pressure is applied until the sample ruptures. The pressure is reported as the Burst strength.

Average fiber length of sheet fluff pulp or fluffed pulp—determined using a KAJAANI FS-200 Fiber Analyzer at a fiber count per second of about 30–50.

EXAMPLES 1 and 2

A comparison was made between a dried fluff pulp sheet (and the fluffed pulp fibers obtained therefrom) made in accordance with a conventional fluff pulp process and in accordance with the process of the present invention using a conventional disc refiner. Both pulps were prepared using bleached kraft southern pine fibers. The results are presented in Table 1.

TABLE 1

| | Control | Example 1 | Example 2 |
|---|---|---|---|
| Refining Energy (hp-day/dry ton) | — | 0.5 | 0.75 |
| Burst Index (kPa · $m^2$/g) | 1.83 | 2.13 | 2.18 |
| Fluff Pulp Sheet Density (g/$cm^3$) | 0.47 | 0.50 | 0.50 |
| Average Fiber Length (mm) | 2.55 | — | 2.57 |
| Dry Compression of Fluffed Pulp (g/cc) | 0.158 | 0.174 | 0.198 |

The data illustrate that the process of the present invention, using a mild refining level of 0.5 and 0.75 hp-days/ton dry pulp produced a fluff pulp sheet having a burst index of 2.13 and 2.18 kPa·$m^2$/g respectively and a sheet density of about 0.5 g/cc. Importantly, average fiber length (measured using samples of the fluff pulp sheet) was virtually unchanged by the refining step, while the dry compression of the fluffed pulp made from the sheet was increased by about 10 to 25%.

EXAMPLE 3

Samples of pulp manufactured as the previous examples were taken from the pulp slurry immediately before and after the refining step. That average fiber length was determined and are reported in Table 2. Notably, the mild refining step did not significantly change the average length of the pulp fibers.

TABLE 2

| | Control | Example 3 |
|---|---|---|
| Refining Energy (hp-day/dry ton) | — | 0.75 |
| Average Fiber Length (mm) | 2.67 | 2.59 |

EXAMPLE 4

Fluff pulp sheet manufactured as in Example 2 above, and a standard bleached kraft southern pine fluff pulp sheet, Golden Isles 4800, available from Georgia-Pacific Corp. were used in the production of baby diapers. The fluff pulp sheets were fluffed, blended with super absorbent granules and formed into the absorbent core of the diapers on a commercial diaper making machine. Both sets of diapers were subjected to similar debulking and densifying processes. Data in Table 3 show the improved absorbent performance of the diapers made using the fluff pulp sheet of the present invention. Rewet values are significantly decreased using the fluffed pulp of the present invention at what was observed to be a similar fluid acquisition, indicating better fluid capture by the diaper. Diapers made with the mildly refined fluff pulp also show a higher density than the comparison diapers.

TABLE 3

| Source of Fluff Pulp | Golden Isles 4800 | Example 2 |
|---|---|---|
| Rewet (g) | 10 | 5 |
| Pad Density (g/$cm^3$) | 0.18–0.19 | 0.21 |

Thus, the invention, which is intended to be protected herein, is not to be construed as limited to the particular forms disclosed, since they are to be regarded as illustrative rather than restrictive. Variations and changes may be made by those skilled in the art without departing from the spirit of the invention. The method, and resulting fluff pulp of the present invention, permits absorbent articles to be produced having a higher fiber pad density at a similar production condition heretofore used with fluffed pulp made from conventional fluff pulp. In order to get similar density improvements in articles such as diapers, made from fluffed pulp obtained from conventional fluff pulp, it is necessary to operate at higher production line pressures which lead to a decrease in production efficiency and an increase in waste due to instability in the resulting diaper pad.

I claim:

1. In a process for making a dried fluff pulp sheet from a chemical pulp slurry which comprises the steps of sheet formation, pressing and drying, the improvement comprising mildly refining the chemical pulp slurry prior to sheet formation, whereby the chemical pulp slurry is refined sufficient to produce a dried fluff pulp sheet from which a fluffed pulp is prepared having improved dry compression characteristics relative to a fluff pulp similarly prepared without any refining; and wherein the chemical pulp slurry is refined sufficient to produce a dried fluff pulp sheet having a burst index value between about 0.5 and about 3.0 kPa $m^2$/g and a density between about 0.4 and about 0.7 g/$cm^3$.

2. The process of claim 1 wherein said mild refining reduces pulp fiber average length by no more than about 20%.

3. The process of claim 2 wherein the pulp fiber average length is reduced by no more than about 10%.

4. The process of claim 2 wherein the pulp fiber average length is reduced between 0 and about 5%.

5. In a process for making a dried fluff pulp sheet from a chemical pulp slurry which comprises the steps of sheet formation, pressing and drying, the improvement comprising mildly refining the chemical pulp slurry, at a consistency of 2 to 4% by weight using a power input of 0.5 to 1.0 hp·day/ton of dry pulp, prior to sheet formation, whereby the chemical pulp slurry is refined sufficient to produce a dried fluff pulp sheet from which a fluffed pulp is prepared having improved dry compression characteristics relative to a fluff pulp similarly prepared without any refining; and wherein the chemical pulp slurry is refined sufficient to produce a dried fluff pulp sheet having a burst index value between about 0.5 and about 3.0 kPa·$m^2$/g and a density between about 0.4 and about 0.7 g/$cm^3$.

6. The process of claim 5 wherein the mild refining reduces pulp fiber average length by no more than about 20%.

7. The process of claim 6 wherein the pulp fiber average length is reduced by no more than about 10%.

8. The process of claim 6 wherein the pulp fiber average length is reduced by no more than about 5%.

9. In a process for making a dried fluff pulp sheet from a chemical pulp slurry which comprises the steps of sheet formation, pressing and drying, the improvement comprising mildly refining the chemical pulp slurry, at a consistency of 2% to 4% by weight using a power input of 0.5 to 1.0 hp·day/ton of dry pulp, prior to sheet formation, wherein the chemical pulp slurry is refined sufficient to produce a dried fluff pulp sheet having a burst index value between about 1.5 and about 2.5 kPa·$m^2$/g, a density between about 0.5 and about 0.6 g/$m^3$, and to produce a dried fluff pulp sheet from which a fluffed pulp is prepared having improved dry compression characteristics relative to a fluff pulp similarly prepared without said refining; and wherein said mild refining reduces pulp fiber average length by no more than about 5%.

* * * * *